US006910956B1

(12) United States Patent
Wu et al.

(10) Patent No.: US 6,910,956 B1
(45) Date of Patent: Jun. 28, 2005

(54) WAFER GRINDING APPARATUS

(75) Inventors: Mu-Jung Wu, Hsin-Chu (TW); Ming-Yen Chung, Kao-Hsiung (TW)

(73) Assignee: Powerchip Semiconductor Corp., Hsin-Chu (TW)

( * ) Notice: Subject to any disclaimer, the term of this patent is extended or adjusted under 35 U.S.C. 154(b) by 0 days.

(21) Appl. No.: 10/707,561

(22) Filed: Dec. 22, 2003

(51) Int. Cl.[7] ..... B24B 7/00
(52) U.S. Cl. ..... 451/67; 451/444; 451/388
(58) Field of Search ..... 451/285, 286, 451/287, 288, 289, 388, 397, 398, 444, 67

(56) References Cited

U.S. PATENT DOCUMENTS 6,126,530 A * 10/2000 Hirata ..... 451/444
6,257,966 B1 * 7/2001 Ishikawa et al. ..... 451/67
6,293,855 B1 * 9/2001 Yoshida et al. ..... 451/67
6,319,105 B1 * 11/2001 Togawa et al. ..... 451/287
6,752,692 B2 * 6/2004 Wada et al. ..... 451/8

FOREIGN PATENT DOCUMENTS

JP 11-285987 10/1999
TW 490359 6/2002

* cited by examiner

*Primary Examiner*—Dung Van Nguyen
(74) *Attorney, Agent, or Firm*—Winston Hsu

(57) ABSTRACT

A wafer grinding apparatus includes a wafer-transporting device for transporting a wafer, a first nozzle, and a second nozzle. The wafer-transporting device includes at least a suction pad having a first surface and a second surface that is flexible for sucking the wafer, and a transporting mechanism connected to the first surface of the suction pad for transporting the wafer. The first nozzle is used for ejecting a first liquid to the first surface of the suction pad for cleaning the first surface, and the second nozzle is used for ejecting a second liquid to the second surface of the suction pad and the wafer for cleaning the second surface and the wafer.

15 Claims, 10 Drawing Sheets

WAFER GRINDING APPARATUS

BACKGROUND OF INVENTION

1. Field of the Invention

The present invention relates to a wafer grinding apparatus, and more specifically, to a wafer backside grinding apparatus capable of preventing cross-shaped flaws from forming in the wafer.

2. Description of the Prior Art

A wafer grinding apparatus is used for grinding a backside of a semiconductor wafer, so that a thickness of the wafer can be well controlled for facilitating the following packaging processes. Generally, the wafer grinding apparatus includes a positioning table for adjusting an orientation of the wafer, grinding tables where a wafer grinding process is performed, and a spinner table where a cleaning process is performed. Additionally, the wafer grinding apparatus further includes a wafer-transporting device for transferring the wafer from one table to another table. Since the wafer-transporting device contacts the semiconductor wafer frequently, the wafer-transporting device should be well designed for preventing the semiconductor wafer from being damaged.

Please refer to FIG. 1 and FIG. 2. FIG. 1 is a schematic diagram of a wafer-transporting device of a wafer grinding apparatus according to the prior art. FIG. 2 is a schematic diagram illustrating a wafer having a cross-shaped flaw thereon. As shown in FIG. 1, a prior art wafer-transporting device 10 includes a suction pad 12 for sucking a wafer 16 through vacuum suction, and a transporting arm 14 connected to the suction pad 12 for transferring the wafer 16 sucked by the suction pad 12. Additionally, the suction pad 12 comprises a ceramic material so that an upper surface 12*a* and a lower surface 12*b* of the suction pad 12 are both quite hard.

Generally, a wafer backside grinding process is performed in the wafer grinding apparatus for grinding a backside of the wafer 16. As a result of the wafer backside grinding process, a thickness of the wafer 16 can be reduced to 30 micrometers ($\mu$m) or less, thereby facilitating the following packaging processes. However, a lot of particles 18, such as silicon powder, are generated while the wafer backside grinding process is performed. The particles 18 are always attached on the wafer 16, and the upper surface 12*a* and the lower surface 12*b* of the suction pad 12, as shown in FIG. 1 and FIG. 2. Since the particles 18 are attached on the ground wafer 16 whose thickness is quite thin, and the suction pad 12 has a large and hard lower surface 12*b*, a cross-shaped flaw 20 is therefore formed in the ground wafer 16 when the ground wafer 16 is sucked by the suction pad 12 through vacuum suction. Unfortunately, once the cross-shaped flaw is formed in the wafer 16, the wafer 16 usually should be scrapped. Nevertheless, a lot of integrated circuits and metal interconnects have been manufactured in the wafer 16 before the wafer backside grinding process is performed, so that it not only reduces a production yield but also increases a production cost to scrap the wafer 16.

SUMMARY OF INVENTION

It is therefore a primary objective of the claimed invention to provide a wafer grinding apparatus in order to solve the above-mentioned problem.

According to the claimed invention, a wafer grinding apparatus is provided. The wafer grinding apparatus includes a wafer-transporting device for transporting a wafer, a first nozzle, and a second nozzle. The wafer-transporting device includes at least a suction pad having a first surface and a second surface that is flexible for sucking the wafer, and a transporting mechanism connected to the first surface of the suction pad for transporting the wafer. The first nozzle is used for ejecting a first liquid to the first surface of the suction pad for cleaning the first surface, and the second nozzle is used for ejecting a second liquid to the second surface of the suction pad and the wafer for cleaning the second surface and the wafer.

It is an advantage over the prior art that the claimed invention provides the flexible second surface for sucking the wafer, thereby decreasing an impact force sustained by the wafer while the wafer is sucked by the suction pad. Additionally, the claimed invention further provides the first nozzle and the second nozzle to wash the contaminants from the suction pad, thus preventing cross-shaped flaws from forming in the wafer.

These and other objectives of the claimed invention will no doubt become obvious to those of ordinary skill in the art after reading the following detailed description of the preferred embodiment, which is illustrated in the multiple figures and drawings.

DETAILED DESCRIPTION

Figure 3:
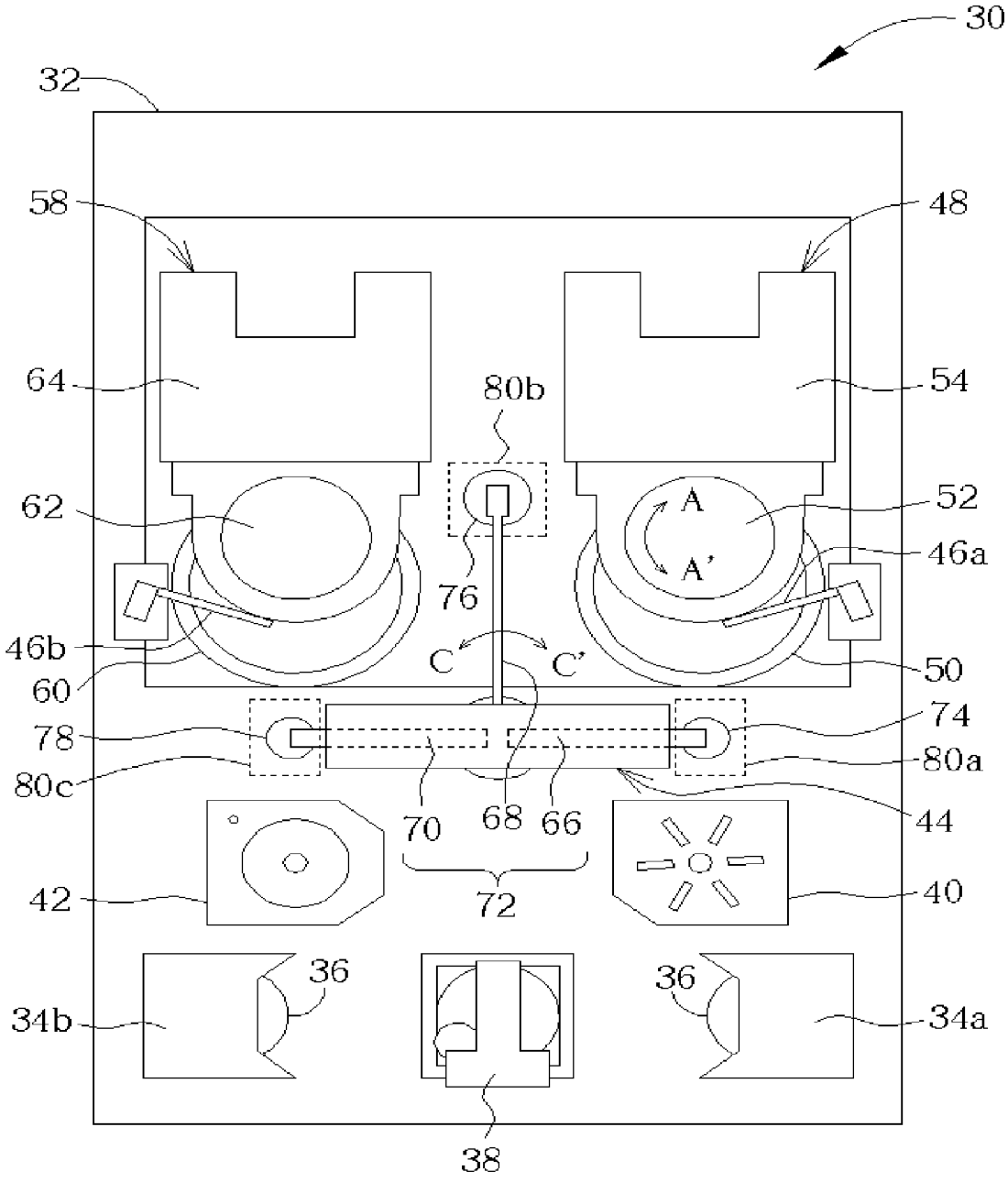
FIG. 3 to FIG. 6 are schematic diagrams of a wafer grinding apparatus according to the first embodiment of the present invention.

Please refer to FIG. 3 to FIG. 6. FIG. 3 to FIG. 6 are schematic diagrams of a wafer grinding apparatus according to the first embodiment of the present invention. As shown in FIG. 3, a wafer grinding apparatus 30 includes a housing 32, two cassette supporting tables 34*a* and 34*b* for situating a plurality of wafers 36, a positioning table 40 for adjusting an orientation of each wafer 36, a spinner table 42 for washing each ground wafer 36, and a robot 38 for transferring each wafer 36 from the cassette supporting table 34*a* to the positioning table 40 or from the spinner table 42 to the cassette supporting table 34*b*. Additionally, the wafer grinding apparatus 30 further includes two thickness-measuring units 46*a* and 46*b* for measuring a thickness of each wafer 36, and two grinding devices 48 and 58 for grinding a backside of each wafer 36 to reduce the thickness of each wafer 36. The wafer grinding apparatus 30 is a wafer backside grinding apparatus, the grinding device 48 is a coarse-grinding device, and the grinding device 58 is a fine-grinding device.

Figure 4:
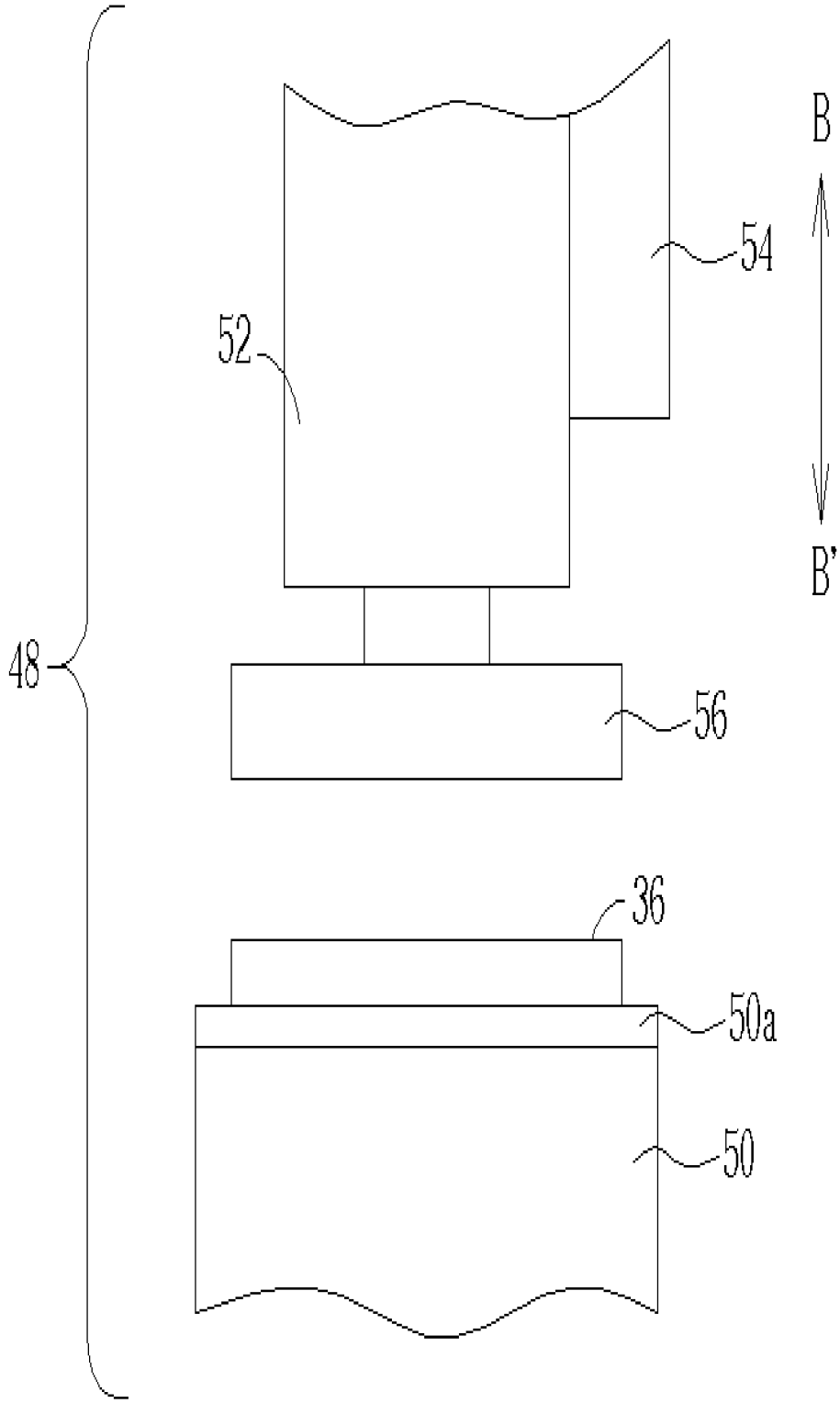

As shown in FIG. 3 and FIG. 4, the coarse-grinding apparatus 48 includes a grinding table 50, a grinding wheel 56 (only shown in FIG. 4), a rotary driving unit 52 connected to the grinding wheel 56, and a sliding driving unit 54 connected to the rotary driving unit 52. The grinding table 50 is used to situate and fix the wafer 36 whose front side faces the grinding table 50, and a protection tape 50*a* is positioned on the grinding table 50 for protecting integrated circuits located on the front surface of the wafer 36. Additionally, the rotary driving unit 52 is used to drive the grinding wheel 56 to rotate along a direction shown by double arrow AA of FIG. 3, while the sliding driving unit 54 functions to drive the rotary driving unit 52 and the grinding wheel 56 to move along a direction shown by double arrow BB of FIG. 4. Furthermore, the grinding wheel 56 has a plurality of wheel teeth (not shown) located thereon, and each wheel tooth is made of diamond particles and a binding agent for binding the diamond particles. As the rotary driving unit 52 drives the grinding wheel 56 to rotate, the backside of the wafer 36 is ground by the wheel teeth on the grinding wheel 56. In addition, the fine-grinding device 58 includes a grinding table 60, a grinding wheel (not shown), a rotary driving unit 62, and a sliding driving unit 64, as shown in FIG. 3. The detailed structure of the fine-grinding device 58 is similar to that of the coarse-grinding device 48, and its description is therefore omitted.

As shown in FIG. 3, the wafer grinding apparatus 30 further includes a wafer-transporting device 44 utilized for transferring each wafer 36. Due to the wafer-transporting device 44, each wafer 36 can be moved between two neighboring tables among the positioning table 40, the grinding tables 50 and 60, and the spinner table 42. Additionally, the wafer-transporting device 44 includes a transporting mechanism 72, a suction pad 74, a suction pad 76, and a suction pad 78. The transporting mechanism 72 is a T-shaped arm, which can be rotated along a direction shown by double arrow CC and has a transporting arm 66 connected to the suction pad 74, a transporting arm 68 connected to the suction pad 76, and a transporting arm 70 connected to the suction pad 78. Generally, the transporting arm 66 and the suction pad 74 are used to transfer the wafer 36 from the positioning table 40 to the grinding table 50, the transporting arm 68 and the suction pad 76 are used to move the wafer 36 from the grinding table 50 to the grinding table 60, and the transporting arm 70 and the suction pad 78 are used to transfer the wafer 36 from the grinding table 60 to the spinner table 42. When the wafer-transporting device 44 is idle, the suction pad 74, the suction pad 76, and the suction pad 78 are respectively parked in a parking region 80*a*, a parking region 80*b*, and a parking region 80*c*. Furthermore, the wafer-transporting device 44 includes a plurality of air intake lines (not shown), and an air suction device (not shown) connected to the air intake lines for pumping air. The air intake lines are connected to the suction pad 74, the suction pad 76, and the suction pad 78, and while the air suction device pumps air, the wafer 36 can be sucked by the suction pad 74, the suction pad 76, or the suction pad 78 through vacuum suction.

Figure 1:
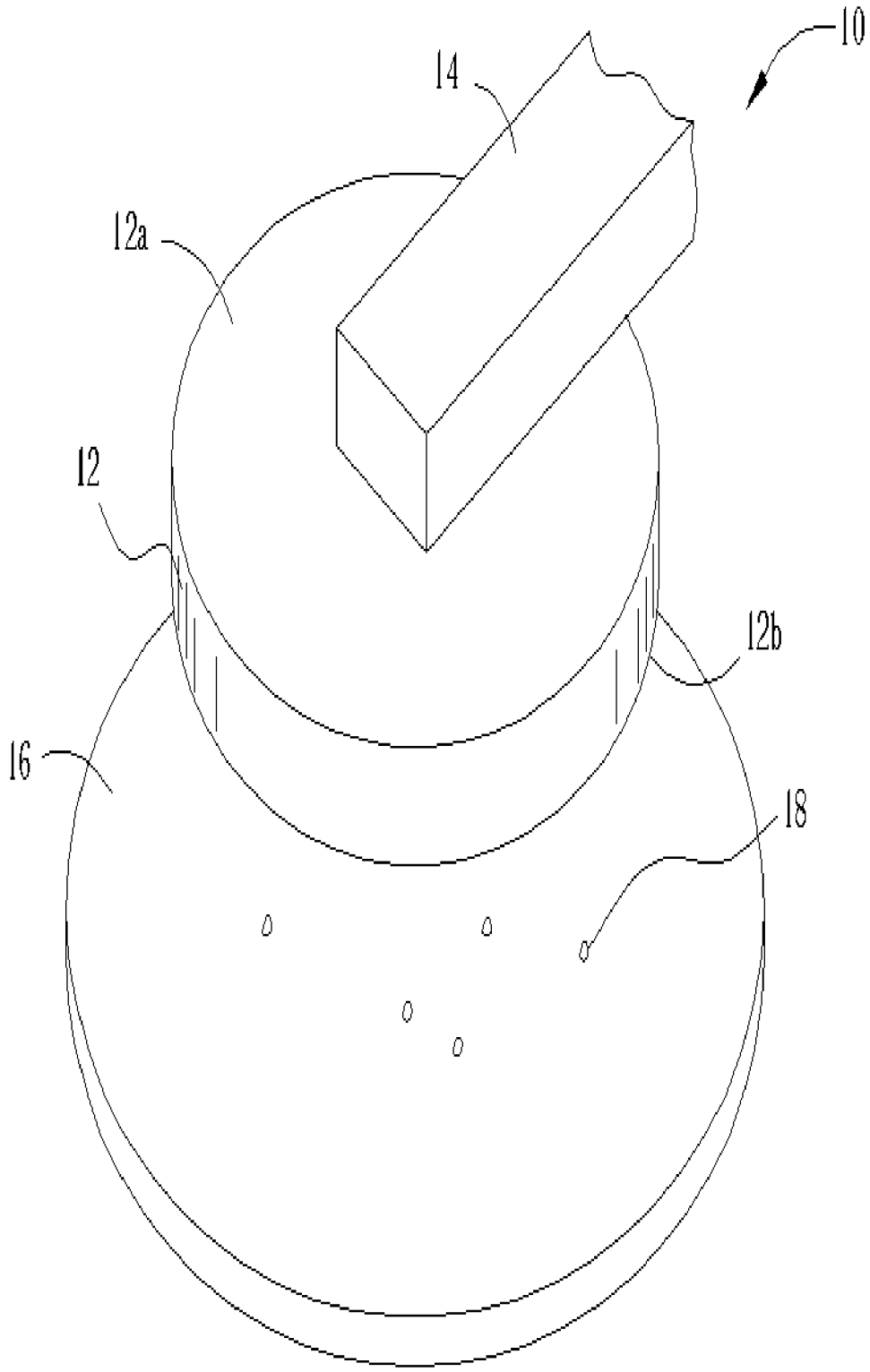
Fig. 1 Prior art
FIG. 1 is a schematic diagram of a wafer-transporting device of a wafer grinding apparatus according to the prior art.
Figure 2:
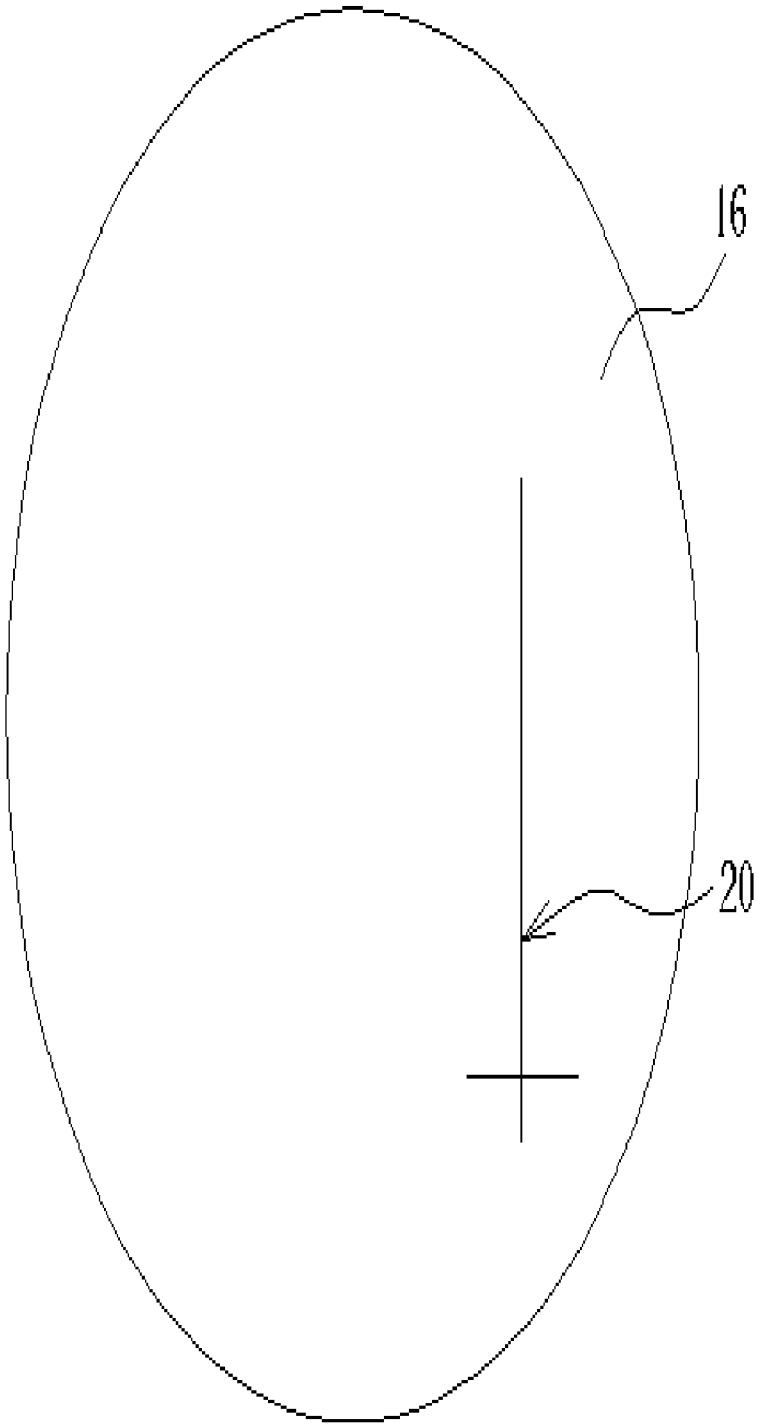
Fig. 2 Prior art
FIG. 2 is a schematic diagram illustrating a wafer having a cross-shaped flaw thereon.
Figure 5:
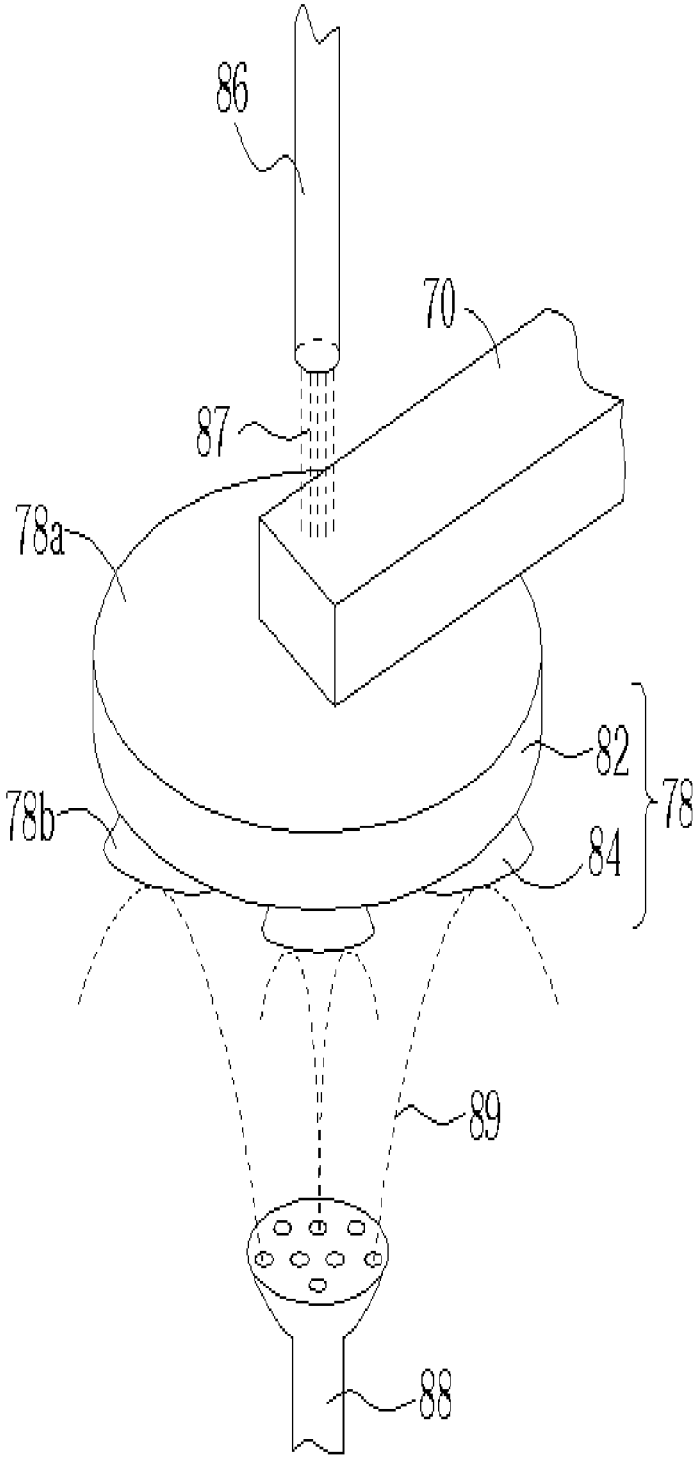
Figure 6:
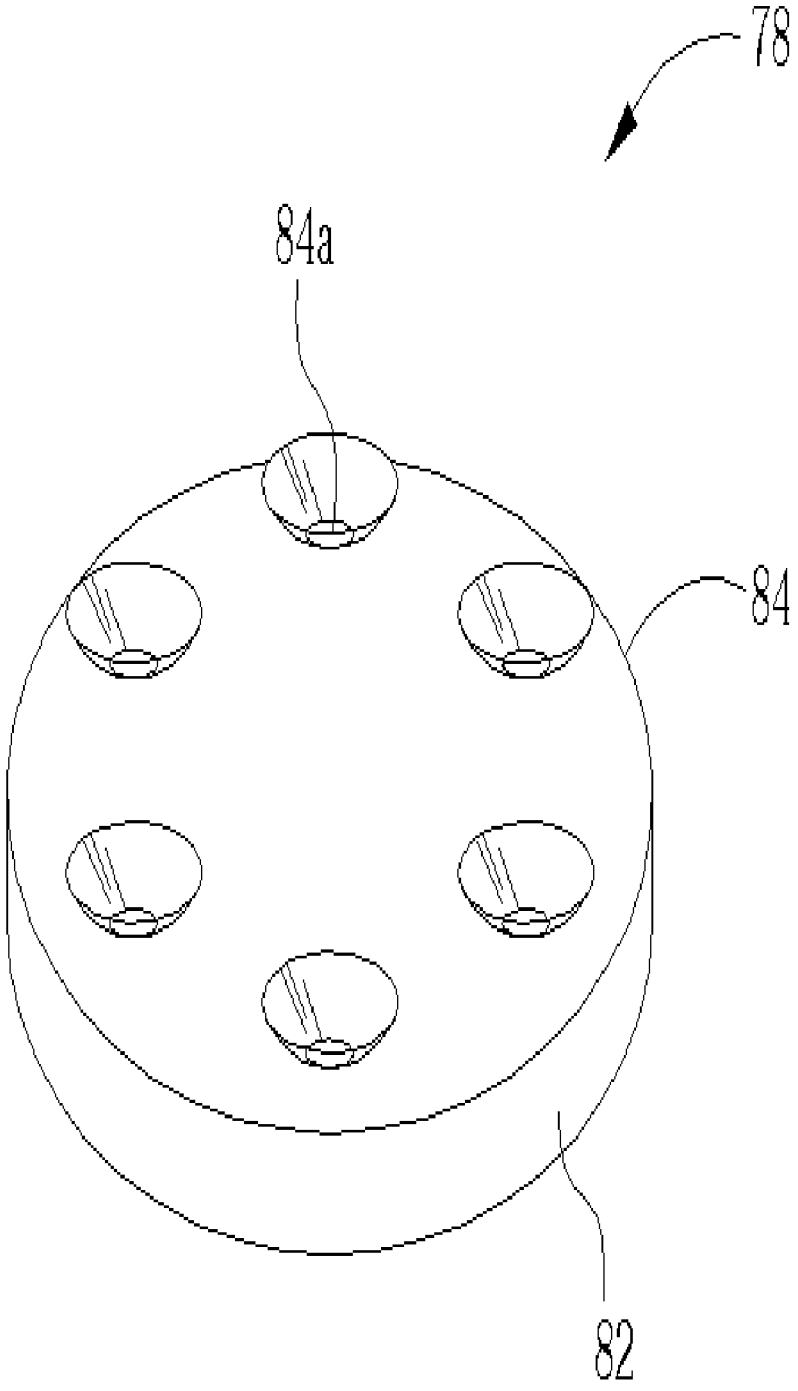

As shown in FIG. 5, the suction pad 78 has an upper surface 78*a* connected to the transporting arm 70, and a lower surface 78*b* that is flexible. Additionally, as the suction pad 78 sucks the wafer 36, the lower surface 78*b* is in contact with the wafer 36 and the transporting arm 70 moves the wafer 36 to one of the above-mentioned tables. Furthermore, the suction pad 78 includes a pedestal 82, and six flexible suction trays 84 that are equally spaced and located on a peripheral region of the pedestal 82, as shown in FIG. 6. Each of the flexible suction trays 84 has at least an opening 84*a* communicating with the corresponding air intake line, so that the wafer 36 can be sucked by the suction pad 78 through vacuum suction when the air suction device pumps air. In addition, as shown in FIG. 5, the wafer grinding apparatus 30 further includes a nozzle 86 positioned in the parking region 80*a* and under the suction pad 78, and a spray nozzle 88 located in the parking region 80*a* and above the suction pad 78. The nozzle 86 and the spray nozzle 88 are used to eject water to the suction pad 78 for cleaning the suction pad 78. It should be noted that an area of the suction pad 78 is about one third of that of the suction pad 12 of FIG. 1. Moreover, the amounts, sizes, and shapes of the flexible suction trays 84 are not limited to those shown in FIG. 6. That is to say, the amounts, sizes, and shapes of the flexible suction trays 84 can be changed according to the requirements of processes.

The transporting arm 66 and the transporting arm 68 are both similar to the transporting arm 70, and the suction pad 74 and the suction pad 76 are the same as the suction pad 78. The detailed descriptions of the transporting arms 66, 68 and the suction pads 74, 76 are thereby omitted. Additionally, since the wafer 36 that has not been ground has a larger strength and the suction pad 74 is usually used to suck the wafer 36 that has not been ground, the suction pad 74 also can be designed as the suction pad 12 shown in FIG. 1. Furthermore, each of the parking region 80*b* and the parking region 80*c* includes a nozzle (not shown) and a spray nozzle (not shown) for washing the suction pad 76 and suction pad 74. Because the nozzles and the spray nozzles located in the parking regions 80*b* and 80*c* are the same as those in the parking region 80*a*, their detailed descriptions are omitted.

Please refer to FIG. 3. The operation of the wafer grinding apparatus 30 is explained as follows. First, the robot 38 takes out a wafer 36 from the cassette supporting table 34*a* or the cassette supporting table 34*b*, and transfers the wafer 36 to the positioning table 40 to adjust an orientation of the wafer 36. Then, the wafer-transporting device 44 drives the suction pad 74 to suck the wafer 36 on the positioning table 40, and the transporting arm 66 transfers the wafer 36 to the grinding table 50 where a coarse-grinding process is performed on the wafer 36. After the coarse-grinding process is completed, the transporting arm 68 rotates towards the grinding table 50 to make the suction pad 76 suck the wafer 36, and then, the transporting arm 68 moves the wafer 36 to the grinding table 60 where a fine-grinding process is performed on the wafer 36. After the fine-grinding process is completed, the wafer-transporting device 44 drives the suction pad 78 to suck the wafer 36 on the grinding table 60, and the transporting arm 70 transfers the wafer 36 to the spinner table 42 where a cleaning process is performed on the wafer 36. Thereafter, the robot 38 transfers the wafer 36 from the spinner table 42 to the cassette supporting table 34*a* or the cassette supporting table 34*b*. Finally, the transporting arm 66, the transporting arm 68, and the transporting arm 70 respectively parks in the parking region 80*a*, the parking region 80*b*, and the parking region 80*c*.

Noticeably, a size of the suction pad 78 is about one third of that of the prior art suction pad 12, so that a contacting area between the suction pad 78 and the wafer 36 is so small that cross-shaped flaws can be prevented from forming in the wafer 36. Additionally, since the suction pad 78 has six flexible suction trays 84, the wafer 36 is in contact with six flexible surfaces as the suction pad 78 sucks the wafer 36. Because of the flexible suction trays 84, an impact force sustained by the wafer 36 when the suction pad 78 sucks the wafer 36 can be reduced, thus effectively preventing cross-shaped flaws from forming in the wafer 36. Furthermore, since the lower surface 78*b* is flexible, the lower surface 78*b* can vary its shape to fit the surface of the wafer 36. Accordingly, even though the wafer 36 contains particles thereon, cross-shaped flaws can be prevented from forming in the wafer 36. Moreover, when the suction pad 78 parks in the parking region 80*a* of FIG. 3, the nozzle 86 of FIG. 5 ejects water 87 to the upper surface 78*a* to wash the contaminants away from the upper surface 78*a*, and simultaneously, the spray nozzle 88 of FIG. 5 ejects water 89 to the lower surface 78*b* to wash the contaminants away from the lower surface 78*b*. Noticeably, because the spray nozzle 88 can eject water 89 to the entire lower surface 78*b*, the contaminants can be completely removed from the lower surface 78*b*, thus preventing cross-shaped flaws from forming in the wafer 36. In addition, when the suction pad 78 sucks the wafer 36 and passes through the parking region 80*a* of FIG. 3, the spray nozzle 88 of FIG. 5 ejects water to wash the surface of the wafer 36.

Figure 7:
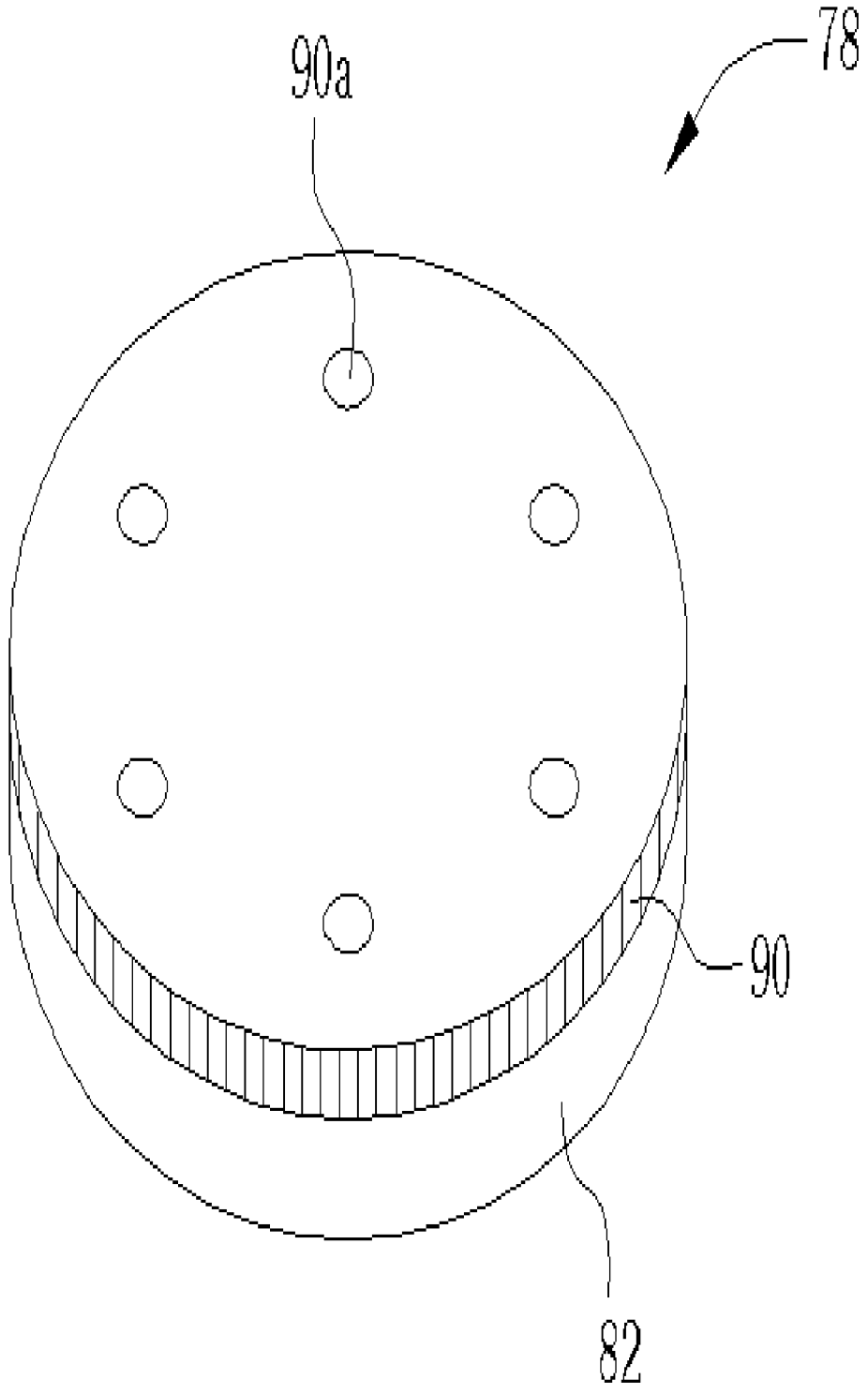
FIG. 7 is a schematic diagram of a suction pad according to the second embodiment of the present invention.

In addition, the structure of the suction pad 78 is not limited to that shown in FIG. 6, and the following description will introduce other embodiments of the present invention. For convenience of explanation, the same elements of FIG. 6 to FIG. 10 are indicated by the same symbols. Please refer to FIG. 7. FIG. 7 is a schematic diagram of a suction pad according to the second embodiment of the present invention. As shown in FIG. 7, the suction pad 78 includes a pedestal 82, an elastic pad 90, and a plurality of openings 90*a*. Each of the openings 90*a* is located in the pedestal 82 and the elastic pad 90, and communicates with the corresponding air intake line.

Figure 8:
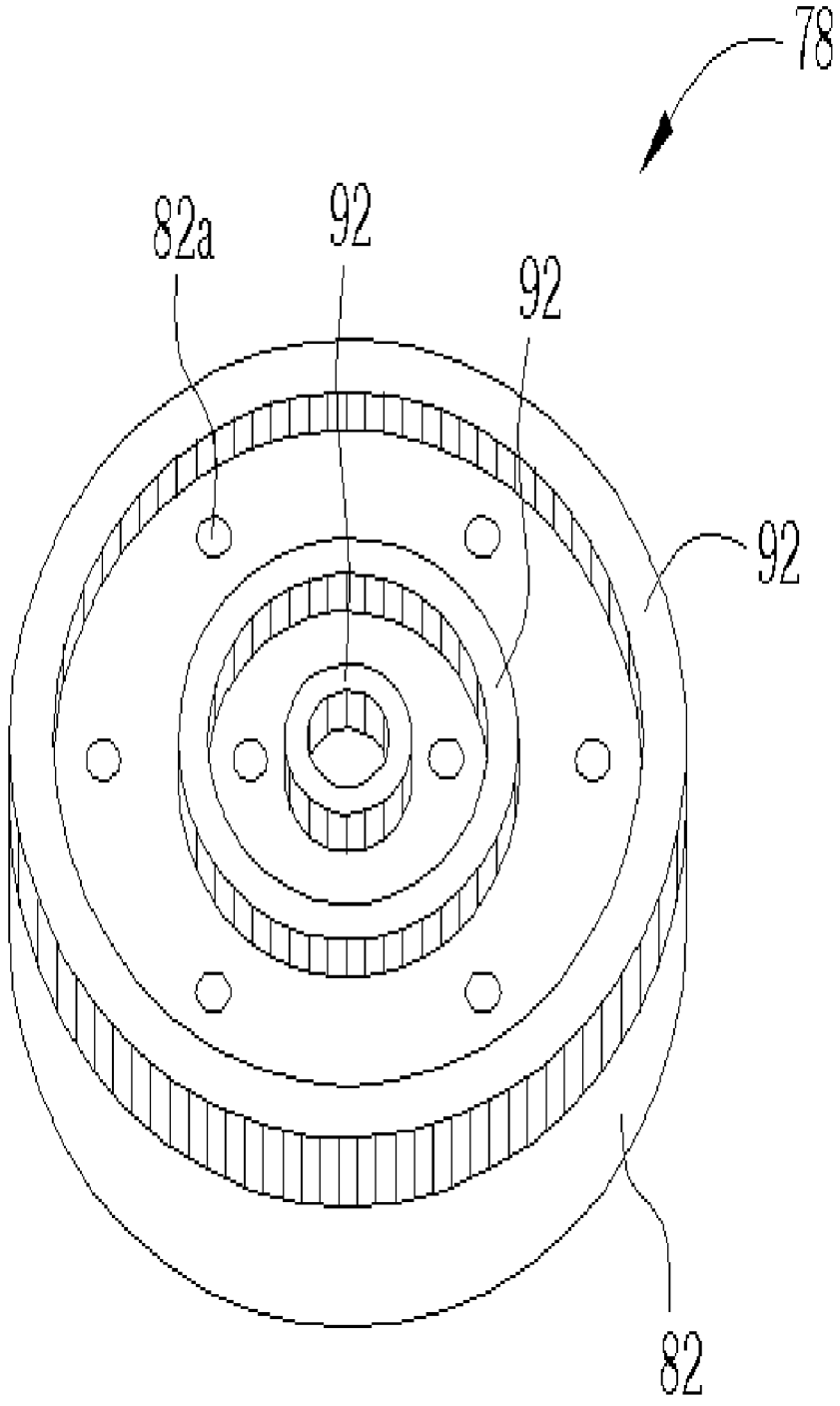
FIG. 8 is a schematic diagram of a suction pad according to the third embodiment of the present invention.

Please refer to FIG. 8. FIG. 8 is a schematic diagram of a suction pad according to the third embodiment of the present invention. As shown in FIG. 8, the suction pad 78 includes a pedestal 82, a plurality of elastic rings 92, and a plurality of openings 82*a*. The elastic rings 92 are concentric circles, and each of the openings 82*a* is located in the pedestal 82 and communicates with the corresponding air intake line.

Figure 9:
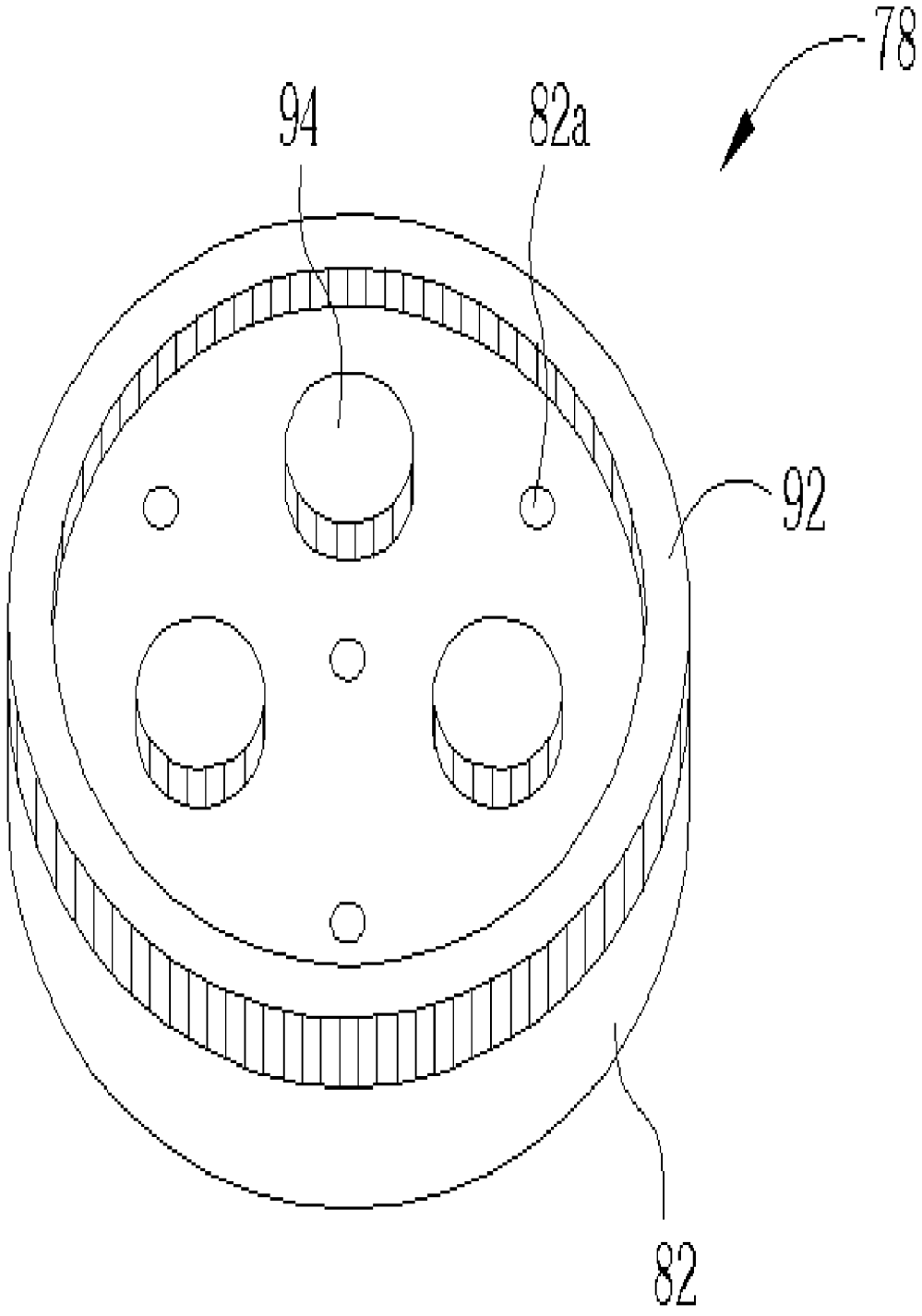
FIG. 9 is a schematic diagram of a suction pad according to the fourth embodiment of the present invention.

Please refer to FIG. 9. FIG. 9 is a schematic diagram of a suction pad according to the fourth embodiment of the present invention. As shown in FIG. 9, the suction pad 78 includes a pedestal 82, a plurality of elastic pads 94 located on the pedestal 82, elastic rings 92 located on the pedestal 82 and surrounding the elastic pads 94, and a plurality of openings 82*a* located in the pedestal 82 and communicating with the corresponding air intake line.

Figure 10:
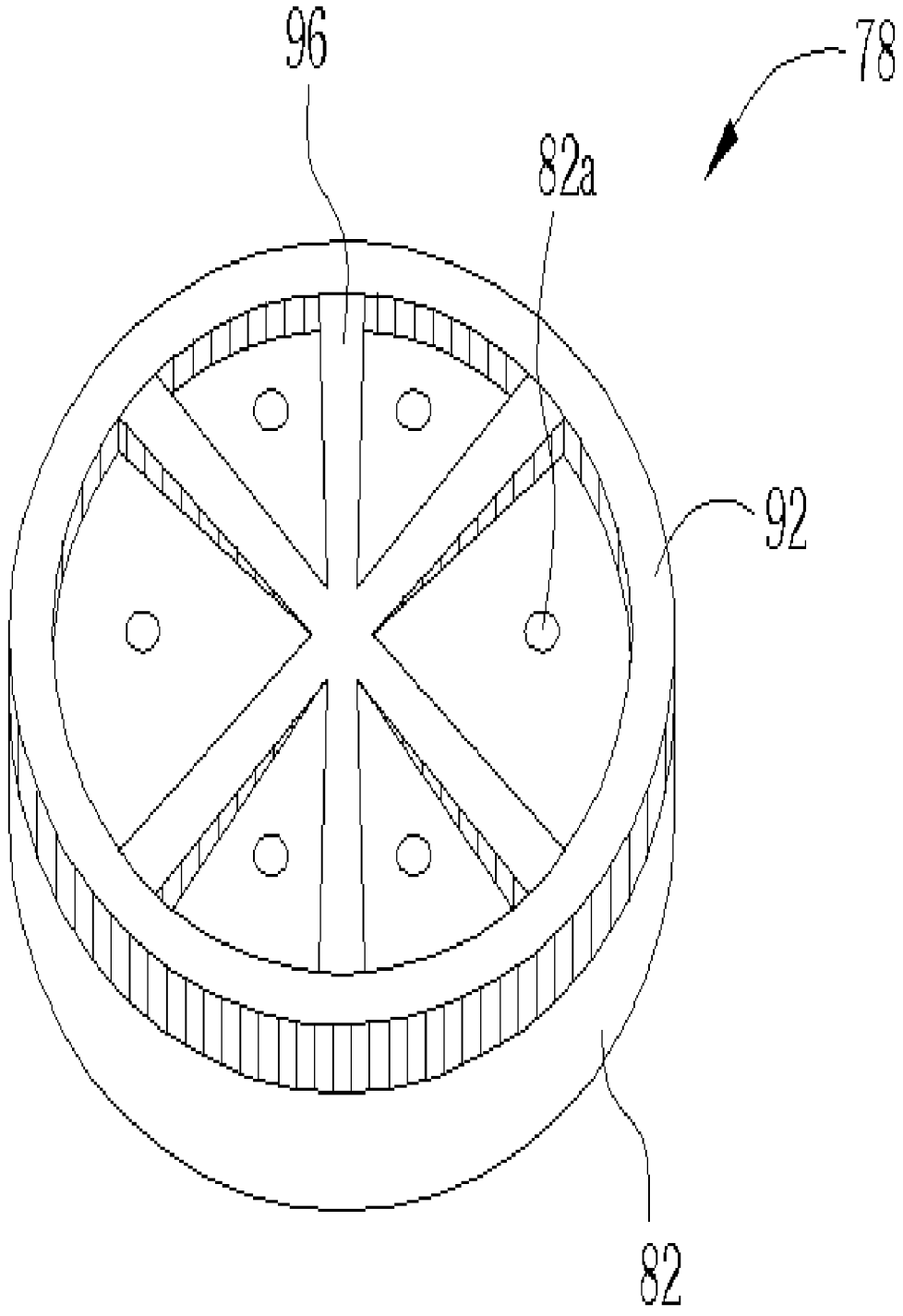
FIG. 10 is a schematic diagram of a suction pad according to the fifth embodiment of the present invention.

Please refer to FIG. 10. FIG. 10 is a schematic diagram of a suction pad according to the fifth embodiment of the present invention. As shown in FIG. 10, the suction pad 78 includes a pedestal 82, a radial elastic pad 96 located on the pedestal 82, elastic rings 92 located on the pedestal 82 and surrounding the radial elastic pad 96, and a plurality of openings 82*a* located in the pedestal 82 and communicating with the corresponding air intake line. Additionally, all of the flexible suction pads, the elastic pads, the elastic rings, and the radial elastic pad comprise flexible materials, such as rubber.

In comparison with the prior art, the suction pad 78 of the present invention includes a flexible and small-sized surface for sucking the wafer 36. Additionally, the present invention further provides the nozzle 86 and the spray nozzle 88 to wash the contaminants from the upper surface and the lower surface of the suction pad 78. As a result, the present invention can prevent cross-shaped flaws from forming in the wafer 36.

Those skilled in the art will readily observe that numerous modifications and alterations of the device may be made while retaining the teachings of the invention. Accordingly, the above disclosure should be construed as limited only by the metes and bound of the appended claims.

What is claimed is:

1. A wafer grinding apparatus comprising:

a wafer-transporting device for transporting a wafer comprising:

at least a suction pad having a first surface and a second surface, the second surface being flexible for sucking the wafer; and a transporting mechanism connected to the first surface of the suction pad for transporting the wafer;

at least a first table and a second table for situating the wafer, wherein the wafer-transporting device is utilized for moving the wafer from the first table to the second table;

at least a parking region for parking the suction pad;

a first nozzle for ejecting a first liquid to the first surface of the suction pad for cleaning the first surface; and a second nozzle for ejecting a second liquid to the second surface of the suction pad and the wafer for cleaning the second surface and the wafer;

wherein when the suction pad stays in the parking region, the first surface and the second surface of the suction pad are cleaned respectively by the first nozzle and the second nozzle, and wherein when the suction pad passes through the parking region, the first surface of the suction pad and the wafer are cleaned respectively by the first nozzle and the second nozzle.

2. The wafer grinding apparatus of claim 1 further comprising at least an air intake line, and an air suction device connected to one end of the air intake line for pumping air.

3. The wafer grinding apparatus of claim 2 wherein the suction pad comprises a pedestal positioned on the transporting mechanism and contains at least a first opening connected to another end of the air intake line.

4. The wafer grinding apparatus of claim 3 wherein the suction pad further comprises a flexible suction tray located on the pedestal and contains at least a second opening communicating with the first opening, and the wafer is sucked by the suction pad through vacuum suction when the air suction device pumps air.

5. The wafer grinding apparatus of claim 3 wherein the suction pad further comprises a plurality of equally spaced flexible suction trays located on a peripheral region of the pedestal, each of the flexible suction trays comprises at least a second opening communicating with the first opening, and the wafer is sucked by the suction pad through vacuum suction when the air suction device pumps air.

6. The wafer grinding apparatus of claim 3 wherein the suction pad further comprises at least an elastic pad positioned on the pedestal and contains at least a second opening communicating with the first opening, and the wafer is sucked by the suction pad through vacuum suction when the air suction device pumps air.

7. The wafer grinding apparatus of claim 3 wherein the suction pad further comprises at least an elastic ring positioned on the pedestal.

8. The wafer grinding apparatus of claim 7 wherein the suction pad further comprises at least an elastic pad positioned on portions of the pedestal not covered by the elastic ring.

9. The wafer grinding apparatus of claim 7 wherein the suction pad further comprises a radial elastic pad positioned on portions of the pedestal not covered by the elastic ring.

10. The wafer grinding apparatus of claim 1 wherein the first table is selected from a group consisting of a positioning table, a grinding table, a spinner table, and a cassette supporting table.

11. The wafer grinding apparatus of claim 1 wherein the second table is selected from a group consisting of a positioning table, a grinding table, a spinner table, and a cassette supporting table.

12. The wafer grinding apparatus of claim 1 wherein the wafer grinding apparatus is utilized to grind a backside of the wafer for preventing cross-shaped flaws from forming in the wafer.

13. The wafer grinding apparatus of claim 1 wherein the second nozzle comprises a spray nozzle.

14. The wafer grinding apparatus of claim 1 wherein the first liquid and the second liquid both comprise water.

15. The wafer grinding apparatus of claim 1 wherein the transporting mechanism comprises a T-shaped arm.

* * * * *